US008641371B2

(12) United States Patent
Nakamura et al.

(10) Patent No.: US 8,641,371 B2
(45) Date of Patent: Feb. 4, 2014

(54) TURBINE SHROUD

(75) Inventors: Orio Nakamura, Wako (JP); Yoshiyuki Ura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 855 days.

(21) Appl. No.: 12/732,850

(22) Filed: Mar. 26, 2010

(65) Prior Publication Data

US 2010/0247298 A1 Sep. 30, 2010

(30) Foreign Application Priority Data

Mar. 27, 2009 (JP) ..... 2009-079731

(51) Int. Cl.
*F01D 9/04* (2006.01)

(52) U.S. Cl.
USPC ..... 415/139; 415/173.1

(58) Field of Classification Search
USPC ..... 415/134, 139, 170.1, 173.1; 416/174
See application file for complete search history.

(56) References Cited

U.S. PATENT DOCUMENTS

| | | | | |
|---|---|---|---|---|
| 3,860,358 | A * | 1/1975 | Cavicchi et al. | 415/173.1 |
| 5,205,708 | A * | 4/1993 | Plemmons et al. | 415/173.1 |
| 5,762,472 | A * | 6/1998 | Pizzi et al. | 415/135 |
| 6,726,446 | B2 * | 4/2004 | Arilla et al. | 415/138 |
| 6,918,743 | B2 * | 7/2005 | Gekht et al. | 415/139 |
| 7,452,183 | B2 * | 11/2008 | Ruthemeyer et al. | 415/135 |
| 2007/0031245 | A1 * | 2/2007 | Ruthemeyer et al. | 415/134 |
| 2010/0247298 | A1 * | 9/2010 | Nakamura et al. | 415/173.1 |

FOREIGN PATENT DOCUMENTS

| | | | | |
|---|---|---|---|---|
| JP | 4-330302 | | 11/1992 | |
| JP | 2000-54804 | | 2/2000 | |
| JP | 2001303907 | A * | 10/2001 | F01D 9/04 |
| JP | 2002242612 | A | 8/2002 | |

* cited by examiner

*Primary Examiner* — Edward Look
*Assistant Examiner* — Christopher R Legendre
(74) *Attorney, Agent, or Firm* — Squire Sanders (US) LLP

(57) ABSTRACT

A turbine shroud (30) of a gas turbine engine comprises a plurality of arcuate shroud segments (31) combined into an annular configuration, each shroud segment including a main body (32) defining an inner circumferential surface opposing the tips of the turbine rotor blades (11*a*) at a small clearance and an engagement feature including an axial wall (33*a*, 34*a*) having a prescribed circumferential length and a prescribed axial length, the turbine casing including an axial slot (51, 52) extending coaxially around the center line of the engine and configured to receive the axially extending wall of each shroud segment. A clearance defined between each circumferential end part (E) of the axial wall and an opposing inner circumferential surface of the turbine casing is greater than that defined between a circumferentially middle part (M) of the axial wall and an opposing inner circumferential surface of the turbine casing under a cool condition of the engine. A radial temperature gradient that develops in each shroud segment when the engine is warmed causes a deformation of the shroud segment such that the clearance can be made substantially uniform over the entire circumference of the shroud segment and the cooling air leakage can be minimized while minimizing thermal stress that may be caused by the thermal expansion of the shroud segment.

8 Claims, 10 Drawing Sheets

TURBINE SHROUD

TECHNICAL FIELD

The present invention relates to a turbine shroud, and in particular to a turbine shroud that surrounds turbine rotor blades of a gas turbine engine and defines an annular cooling fluid chamber.

BACKGROUND OF THE INVENTION

A high pressure turbine of a gas turbine engine is surrounded by an annular turbine shroud, and a small annular gap is defined between the outer tips of the turbine rotor blades and the opposing inner circumferential surface of the turbine shroud. Typically, a turbine shroud is formed by a plurality of arcuate shroud segments combined into an annular assembly, and attached to an inner peripheral wall of a turbine casing. See Japanese patent laid open publication No. 4-330302 and Japanese patent laid open publication No. 2000-54804, for instance.

A turbine shroud is exposed to combustion gas of a high temperature, and this causes a temperature gradient in a radial direction. The temperature gradient in turn causes an uneven thermal expansion of each shroud segment in such a manner that the shroud segment warps in a direction to reduce the curvature radius thereof.

Each shroud segment is typically provided with a hook portion, and the opposing inner circumferential surface of a turbine casing is provided with an annular axial slot opening out in an axial direction. The hook portion is provided with an axial wall that is received in the axial slot, and this secures the shroud segment in position relative to the turbine casing.

The hook portion, along with the main body of the shroud segment, undergoes a thermal expansion as the engine is warmed up. To avoid the thermal expansion of the hook portion from causing undue thermal stress, a prescribed clearance is defined between the outer circumferential surface of the axial wall of the hook portion and opposing inner circumferential surface of the annular axial slot. However, this clearance causes leakage of cooling air from a cooling air chamber defined around the turbine shroud and the opposing surface of the turbine casing into the turbine chamber, and this may impair the performance of the gas turbine engine. In a gas turbine engine, a slight drop in engine performance means a serious problem for fuel economy.

BRIEF SUMMARY OF THE INVENTION

In view of such problems of the prior art, a primary object of the present invention is to provide a turbine shroud that can minimize leakage of cooling air while avoiding any undue thermal stress in the turbine shroud.

A second object of the present invention is to provide a turbine shroud formed by combining a plurality of arcuate shroud segments into an annular assembly that can minimize both leakage of cooling air and thermal stress.

According to the present invention, such an object can be accomplished by providing a turbine shroud attached to an inner circumferential surface of a turbine casing and surrounding tips of turbine rotor blades in a gas turbine engine coaxially with respect to center line of the engine, the turbine shroud comprising a plurality of arcuate shroud segments combined into an annular configuration, each shroud segment including a main body defining an inner circumferential surface opposing the tips of the turbine rotor blades at a small clearance and an engagement feature including an axial wall having a prescribed circumferential length and a prescribed axial length, the turbine casing including an axial slot extending coaxially around the center line of the engine and configured to receive the axially extending wall of each shroud segment, wherein: a clearance defined between each circumferential end part of the axial wall and an opposing inner circumferential surface of the turbine casing is greater than that defined between a circumferentially middle part of the axial wall and an opposing inner circumferential surface of the turbine casing and/or a clearance defined between each circumferential end part of the axial wall and an opposing outer circumferential surface of the turbine casing is smaller than that defined between a circumferentially middle part of the axial wall and an opposing outer circumferential surface of the turbine casing, under a cool condition of the engine.

When exposed to the high temperature of combustion gas in the gas turbine engine, a radial temperature gradient develops in each shroud segment, and this causes a warping or deformation of the shroud segment so as to reduce the curvature radius thereof. By defining a clearance between the axial wall and the opposing inner circumferential surface of the turbine casing so as to be greater in each circumferential end part than in a circumferential middle part under a cool condition of the engine, once the engine is warmed up, the clearance can be made substantially uniform over the entire circumference of the shroud segment so that the cooling air leakage can be minimized while minimizing thermal stress that may be caused by the thermal expansion of the shroud segment.

Alternatively or additionally, a similar result can be effected by defining a clearance between the axial wall and the opposing outer circumferential surface of the turbine casing so as to be smaller in each circumferential end part than in a circumferential middle part under a cool condition of the engine, once the engine is warmed up.

According to a preferred embodiment of the present invention, the engagement feature comprises a hook portion including a radial wall extending radially outward from the main body of each shroud segment in addition to the axial wall, and the shroud segments being arranged substantially continually over an entire circumference of the turbine shroud. Preferably, each turbine segment comprises a front hook portion and a rear hook portion, and, with respect to at least one of the hook portions, a clearance defined between each circumferential end part of the axial wall and an opposing inner circumferential surface of the turbine casing is greater than that defined between a circumferentially middle part of the axial wall and an opposing inner circumferential surface of the turbine casing under a cool condition of the engine. Typically, a cooling air chamber is defined by an outer circumferential surface of the main body, opposing surfaces of the hook portions and an opposing inner circumferential surface of the turbine casing.

According to a certain aspect of the present invention, each circumferential end part of the axial wall has a smaller thickness than the circumferentially middle part of the axial wall under a cool condition of the engine. In such a case, the inner circumferential wall of the axial wall may be defined by a first cylindrical surface, and the outer circumferential surface of the axial wall may be defined by a second cylindrical surface, an axial center line of the first cylindrical surface being offset relative to an axial center line of the second cylindrical surface.

Preferably, each circumferential end portion of the outer circumferential surface of the axial wall is formed as a slanting surface defining a progressively thinner wall thickness toward a corresponding circumferential edge of the circumferential end portion. This contributes to the minimization of the thermal stress of each shroud segment. According to another embodiment of the present invention, at least one of the outer circumferential surface and inner circumferential surface of the axial wall is defined by a non-cylindrical curved surface.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
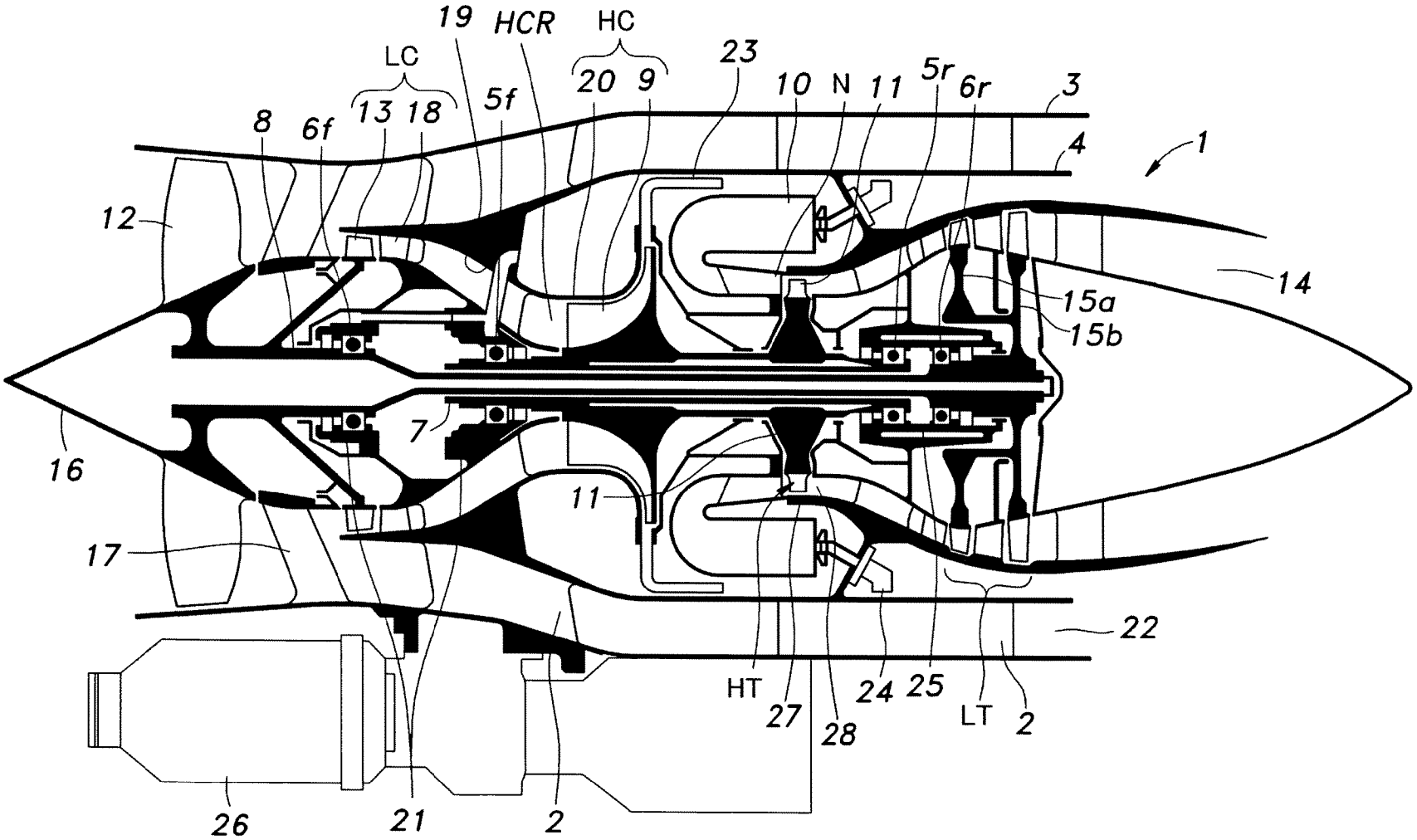
FIG. 1 is a simplified longitudinal sectional view of a gas turbine engine incorporated with a turbine shroud embodying the present invention.

FIG. 1 shows a gas turbine engine in the form of a turbo jet engine using a turbine shroud embodying the present invention. This engine 1 comprises a cylindrical outer casing 3, a cylindrical inner casing 4 coaxially received within the outer casing 3, and a plurality of straightening vanes 2 connecting the inner casing 3 and outer casing 4 with each other. A hollow outer shaft 7 and an inner shaft 8 coaxially received within the outer shaft 7 are passed centrally and axially through the interior of the inner casing 4. These shafts 7 and 8 are rotatably supported at the center of the casings 3 and 4 by using mutually independent bearings 5*f*, 5*r*, 6*f* and 6*r*.

An impeller 9 of a high pressure centrifugal compressor HC is integrally attached to a front end of the outer shaft 7, and a turbine wheel 11 of a high pressure turbine HT is attached to a rear end of the outer shaft 7. Nozzles N of a reverse flow combustor 10 are disposed adjacent to the turbine wheel 11.

A front fan 12 is integrally attached to a front end of the inner shaft 8 that extends out of the front end of the outer shaft 7, and a compressor wheel 13 fitted with rotor blades of a low pressure axial compressor LC is integrally attached to a part of the inner shaft 8 between the front fan 12 and the front end of the outer shaft 7. A pair of turbine wheels 15*a* and 15*b* of a low pressure turbine LT are attached to a rear end of the inner shaft 8 which is located within an ejection duct (jet duct) 14 for conducting combustion gas.

The front fan 12 is centrally provided with a nosecone 16, and a plurality of stator vanes 17 extend radially inward from the outer casing 3 immediately behind the front fan 12.

The inner peripheral part of the inner casing 4 immediately behind the front fan 12 is provided with stator vanes 18 of the low pressure axial compressor LC, and immediately behind or downstream the stator vanes 18 is defined an intake duct 19 for conducting the air pressurized by the low pressure axial compressor LC to the high pressure centrifugal compressor HC. To the downstream end of the intake duct 19 is connected a compression chamber HCR of the high pressure centrifugal compressor HC which is defined by a casing shroud 20 and the impeller 9. To the inner peripheral surface of the intake duct 19 is attached a bearing box 21 for the bearings 5*f* and 6*f* supporting the front ends of the outer shaft 7 and inner shaft 8, respectively.

A part of the air drawn by the front fan 12 is forwarded to the low pressure axial compressor LC, and then to the high pressure centrifugal compressor HC. The remaining part of the air or most part of the air drawn by the front fan 12 is passed rearward in an annular bypass duct 22 defined between the outer casing 3 and inner casing 4 at a relatively low speed to provide a primary thrust force.

To the outer periphery of the high pressure centrifugal compressor HC is connected a diffuser 23 that forwards high pressure air to the reverse flow combustor 10 provided immediately downstream thereof.

In the reverse flow combustor 10, the fuel injected from fuel injector nozzles 24 provided in the rear end thereof is mixed with the high pressure air forwarded from the diffuser 23, and combusted. The combusted gas is expelled from the nozzles N of the reverse flow combustor 10 directed rearward, and is expelled to the atmosphere via the ejection duct 14. This also provides a thrust force.

To the inner peripheral surface of the ejection duct 14 is attached a bearing box 25 for the bearings 5*r* and 6*r* supporting the rear ends of the outer shaft 7 and inner shaft 8, respectively.

The outer shaft 7 is connected to an output shaft of a starter motor 26 via a gear mechanism not shown in the drawings. When the starter motor 26 is activated, the outer shaft 7 along with the impeller 9 of the high pressure centrifugal compressor HC is rotatively actuated, and this causes high pressure air to be supplied to the reverse flow combustor 10. The fuel mixed with this air is combusted, and the produced combustion gas rotatively actuates the high pressure turbine wheel 11 of the high pressure turbine HT and the low pressure turbine wheels 15*a* and 15*b* of the low pressure turbine LT.

The rotatively actuated high pressure turbine wheel 11 causes the impeller 9 of the high pressure centrifugal compressor HC to turn, and the low pressure turbine wheels 15*a* and 15*b* of the low pressure turbine LT cause the front fan 12 and compressor wheel 13 of the low pressure axial flow compressor LC to turn. The pressure of the combustion gas drives the high pressure turbine wheel 11 and low pressure turbine wheels 15*a* and 15*b*. Thus, the jet engine 1 maintains its operation under the balance between the amount of fuel supply and amount of air intake that is established by a feedback action.

The high pressure turbine wheel 11 includes a plurality of turbine rotor blades 11A around the outer periphery thereof, and is coaxially received in an inlet end of a cylindrical turbine chamber 28 defined inside a cylindrical turbine casing 27.

Figure 2:
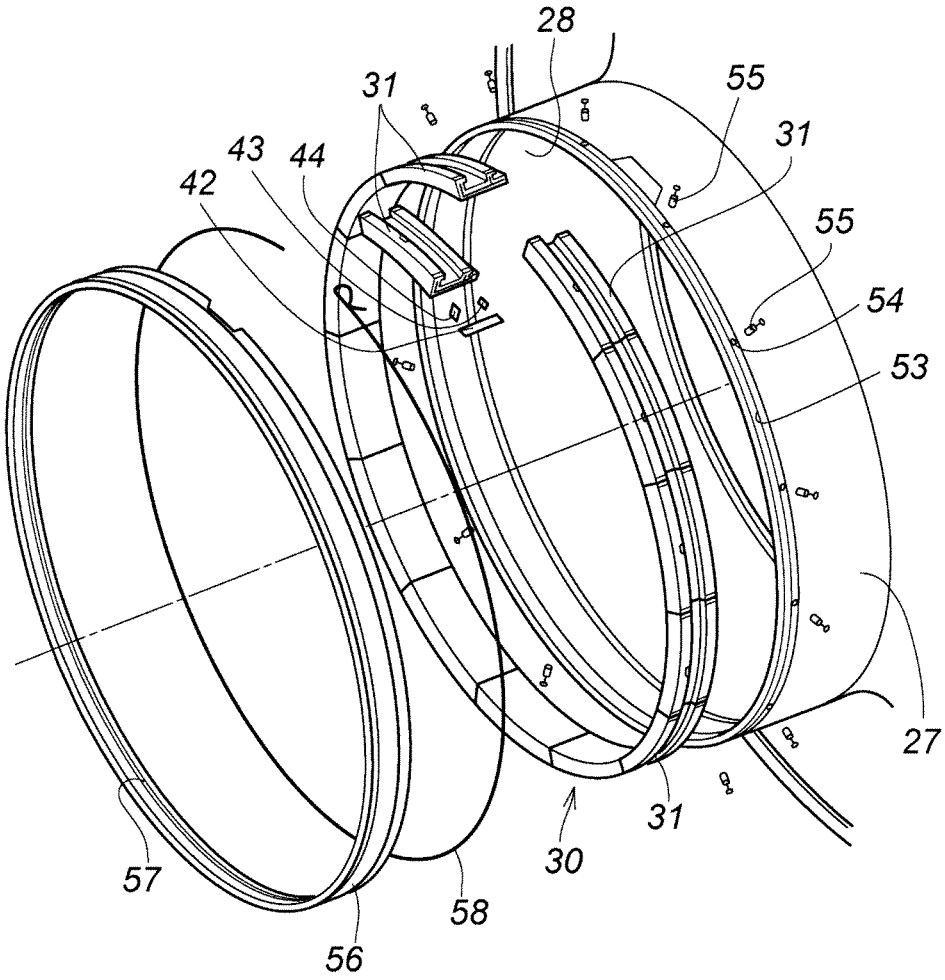
FIG. 2 is an exploded perspective view of the turbine shroud.
Figure 3:
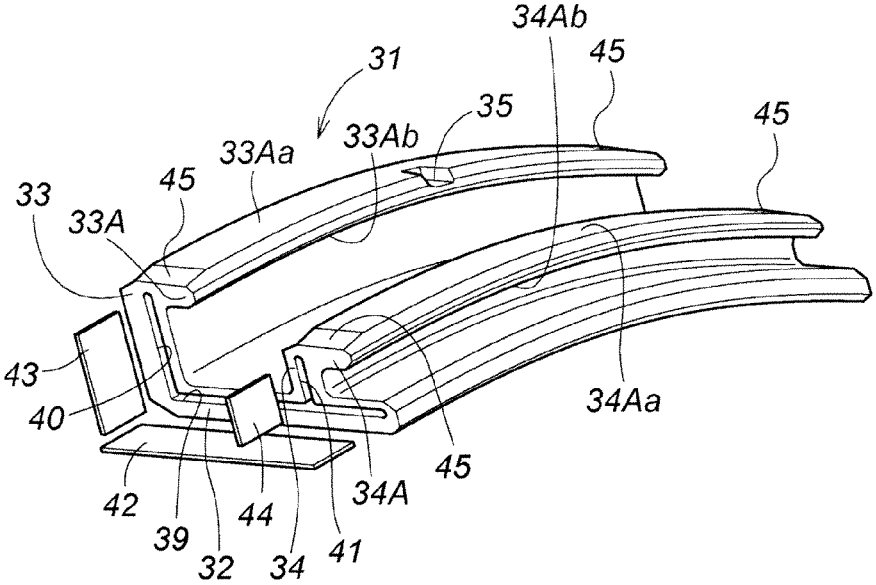
FIG. 3 is an exploded perspective view of a shroud segment.
Figure 4:
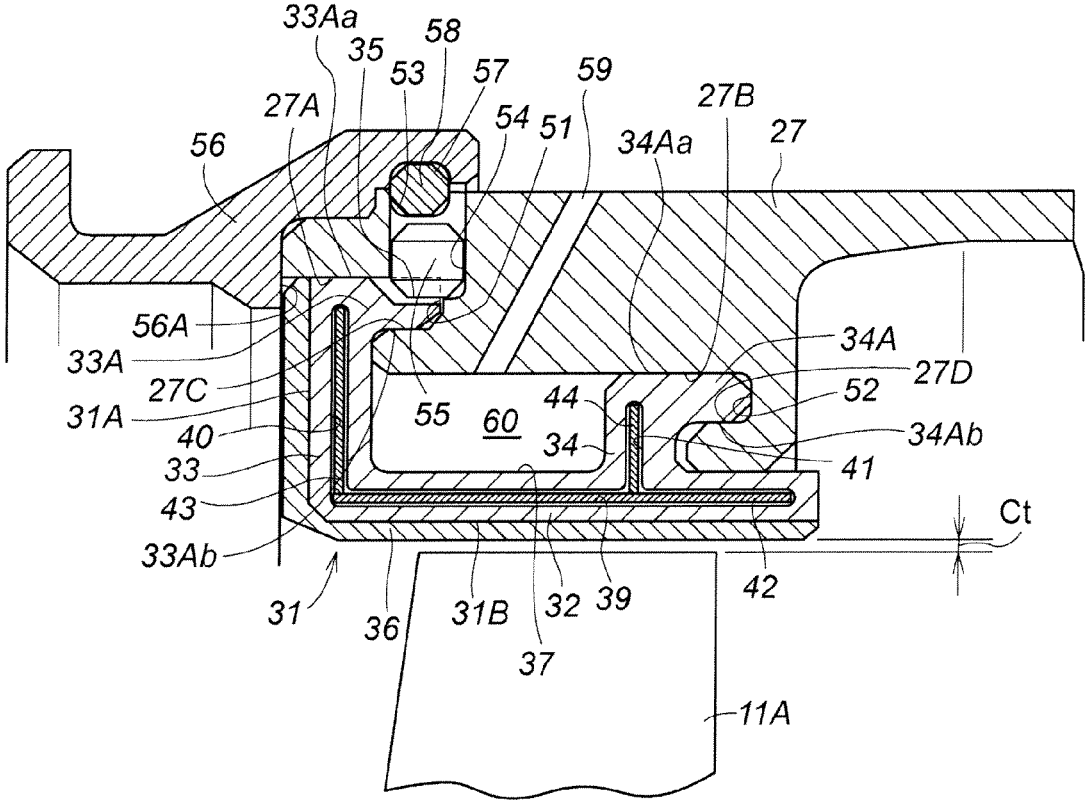
FIG. 4 is a vertical sectional view of the turbine shroud and a surrounding structure.

As shown in FIG. 2, the inner periphery of the inlet end of the turbine casing 27 is fitted with an annular turbine shroud 30 so as to surround the outer periphery of the turbine rotor blades 11A.

The details of the turbine shroud 30 is described in the following with reference to FIGS. 2 to 6. In the following description, the upstream part (left hand side in FIG. 1) with respect to the gas flow in the high pressure turbine HT is referred to as "front", and the downstream part as "rear".

The turbine shroud 30 is formed by combining a plurality (14 in the illustrated embodiment) of arcuate shroud segments 31 into an annular (ring) shape. The shroud segments 31 are identical to each other in shape.

Each shroud segment 31 comprises an arcuate shroud main body 32 defining a clearance Ct with respect to the tips of the turbine rotor blades 11A, a front hook portion 33 extending radially from the front end of the shroud main body 32 and a rear hook portion 34 extending radially from an axially intermediate part of the shroud main body 32. The front hook portion 33 includes an upright wall extending radially outwardly along the entire circumference of the shroud main body 32 and an axial wall 33A extending rearwardly from the radially outer end of the upright wall along the entire circumference thereof. The rear hook portion 34 includes an upright wall extending radially outwardly along the entire circumference of the shroud main body 32 to a height substantially smaller than that of the upright wall of the front hook portion 33 and an axial wall 34A extending rearwardly from the radially outer end of the upright wall along the entire circumference thereof. Thus, each hook portion 33, 34 has the shape of letter-L in a longitudinal sectional view.

Each shroud segment 31 may be made of heat resistant material such as cast Ni-based alloy (INCO 625), and the front end face 31A and inner circumferential surface 31B of the shroud segment 31 which are particularly exposed to the high temperature of the combustion gas are coated with heat resistant coating such as Ni braze alloy or other filter material so as to form a heat resistant layer 36. The heat resistant layer 36 is made of a softer (lower mechanical strength) material than the turbine rotor blades 11A so that the turbine rotor blades 11A are protected from damage even when the turbine rotor blades 11A should contact the heat resistant layer 36.

The inner circumferential surface of the turbine casing 27 is formed with a front annular axial slot 51 and a rear annular axial slot 52, each opening out in a forward direction, in an axially spaced relationship. By axially sliding the turbine casing 27 and shroud segment 31 toward each other, the axial wall 33A of the front hook portion 33 is received in the front annular axial slot 51, and the axial wall 34A of the rear hook portion 34 is received in the rear annular axial slot 52. Thereby, the shroud segment 31 is restrained from moving radially or axially rearwardly with respect to the turbine casing 27.

The turbine casing 27 is additionally formed with an annular groove 53 around the outer periphery of a front end thereof, and a same number (14) of radial holes 54 as the number of the turbine segments 31 are passed through the bottom wall of the annular groove 53 across the thickness of the turbine casing 27.

A recess 35 is formed on the outer periphery of the axial wall 33A of the front hook portion 33 of each shroud segment 31 so that a pin 55 passed into each radial hole 54 fits into the recess 35 of the corresponding shroud segment 31. Thereby, the shroud segments 31 are retained against circumferential movement relative to the turbine casing 27.

The front end of the turbine casing 27 is received in a bore defined in a rear end of a retaining ring 56. The inner peripheral wall of the rear end of the retaining ring 56 is formed with an annular groove 57 that aligns with the annular groove 53 when the front end of the turbine casing 27 is fitted into the rear end of the retaining ring 56. A C-ring 58 having a circular cross section and made of spring material is received in an annular chamber jointly defined by the annular grooves 53 and 57 so that the retaining ring 56 and turbine casing 27 are axially connected to each other.

The retaining ring 56 is provided with an annular shoulder surface or thrust surface 56A facing the front face 31A of the turbine shroud 30 with the heat resistant layer 36 interposed between them. The thrust surface 56A defines a small gap with respect to the opposing heat resistant layer 36 on the front face 31A of the turbine shroud 30 so that thermal expansion of the retaining ring 56 and turbine housing 27 may be accommodated without causing any under stress in these components.

An annular recess 37 is defined on the outer periphery of the turbine shroud 30 between the front hook portion 33 and rear hook portion 34. An annular cooling air chamber 60 is defined by this annular recess 37 and the opposing inner peripheral wall of the turbine casing 27. A cooling air passage 59 is passed across the thickness of the turbine casing 27, and has an inner end communicating with the annular cooling air chamber 60.

Each circumferential end face 32 of each shroud segment 31 is provided with a slot including a main slot segment 39 extending along an axial length of the shroud segment 31 and terminating short of each axial end thereof, a first radial slot segment 40 extending radially outwardly from the main slot segment 39 along the upright wall of the front hook portion 33 and terminating short of the radial tip of the upright wall, and a second radial slot segment 41 extending radially outwardly from the main slot segment 39 along the upright wall of the rear hook portion 34 and terminating short of the radial tip of the upright wall. A seal plate 42, 43, 44 is received in each slot segment so that a common seal plate extends across the opposing slot segments of the adjacent shroud segment 31. Thereby, these seal plates 42, 43, 44 promote an air tight connection between the circumferential end surfaces 32 of the adjacent shroud segments 31, and prevent leakage of combustion gas from the high pressure turbine HT into the annular cooling air chamber 60.

The sealing of the annular cooling air chamber 60 is ensured by proper selection of clearances in various interfaces between the turbine casing 27 and turbine shroud 30. Such clearances are defined by the inner and outer circumferential surfaces of the axial wall 33A, 34A of each hook portion 33, 34. In regard to the front hook portion 33, such clearances are defined between the outer circumferential surface 33Aa of the axial wall 33A and an opposing inner circumferential surface 27A of the annular axial slot 51, and between the inner circumferential surface 33Ab of the axial wall 33A and an opposing outer circumferential surface 27C of the annular axial slot 51. In regard to the rear hook portion 34, such clearances are defined between the outer circumferential surface 34Aa of the axial wall 34A and an opposing inner circumferential surface 27B of the annular axial slot 52, and between the inner circumferential surface 34Ab of the axial wall 34A and an opposing outer circumferential surface 27D of the annular axial slot 52. Such clearances are necessary in order to avoid undue thermal stresses when the engine is in operation and the resulting high temperature of the combustion gas causes thermal expansion of the shroud segments and other associated component parts.

Figure 6:
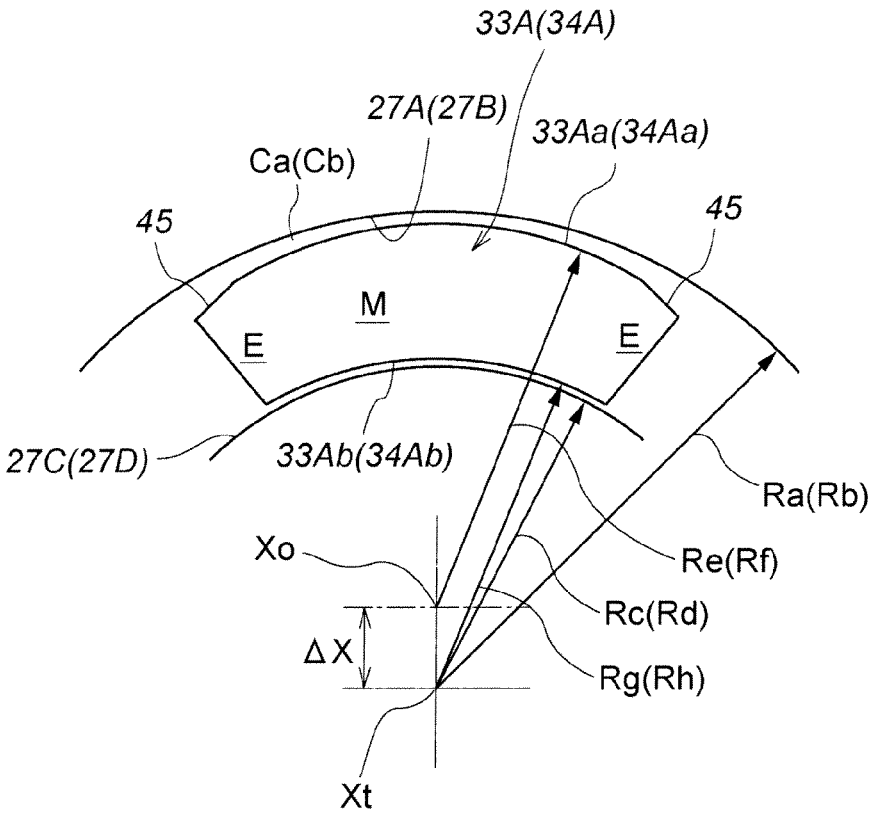
FIG. 6 is a diagram showing the configuration of each shroud segment of the illustrated embodiment.

The shapes and dimensions of the front hook portion 33, front annular axial slot 51, rear hook portion 34 and a rear annular axial slot 52 are described in the following with reference to FIG. 6. The outer circumferential surface 27A of the front annular axial slot 51, the outer circumferential surface 27B of the rear annular axial slot 52, the inner circumferential surface 27C of the front annular axial slot 51 and the inner circumferential surface 27D of the rear annular axial slot 52 are defined by cylindrical surfaces centered around the rotational center line Xt of the turbines and having curvature radii of Ra, Rb, Rc and Rd, respectively.

The inner circumferential surfaces 33Ab and 34Ab of the front and rear axial walls 33A and 34A of the front and rear hook portions 33 and 34 are defined by cylindrical surfaces centered around the rotational center line Xt of the turbines and having curvature radii of Rg and Rh, respectively. The outer circumferential surfaces 33Aa and 34Aa of the front and rear axial walls 33A and 34A of the front and rear hook portions 33 and 34 are defined by cylindrical surfaces centered around an axial center line Xo radially offset from the rotational center line Xt of the turbines by an offset Δx and having curvature radii of Re and Rf, respectively. This radial offset is such that the axial center line X0 is located between the rotational center line Xt and the center of the shroud segment 31. Therefore, in the axial wall of each hook portion, the outer and inner circumferential surfaces define cylindrical surfaces that are not concentric to each other. In particular, each circumferential end portion of the axial wall of each hook portion is thinner than a circumferentially middle portion thereof. Also, whereas the inner circumferential surface of each axial wall is concentric to the rotational center line Xt of the turbines, the outer circumferential surface of the axial wall defines a wider clearance with respect to the opposing wall surface of the turbine shroud in each circumferential end portion than in a circumferentially middle portion thereof when the engine is cold.

When the shroud segment 31 given with an arcuate shape is exposed to the high temperature of the combustion gas, and a radial temperature gradient is produced in each hook portion, the shroud segment demonstrates a tendency to deform or warp in a direction to reduce the curvature radius thereof. Therefore, the clearance between the outer circumferential surface of the axial wall of each hook portion and opposing circumferential surface of the turbine casing 27 remains relatively unchanged in a circumferentially middle part thereof, but significantly diminishes in each circumferential end portion thereof.

In the turbine shroud 30 of the illustrated embodiment, under a normal temperature condition, the clearance between the outer circumferential surface of the axial wall of each hook portion and opposing circumferential surface of the turbine casing 27 is greater in each circumferential end portion thereof E than in the circumferentially middle part thereof M. Thereby, generation of undue thermal stress can be avoided, and the air leakage can be minimized by reducing the clearance Ca, Cb in the circumferentially middle part M of the axial wall 33A, 34A of each hook portion 33, 34.

Therefore, when exposed to the high temperature of the combustion gas during the operation of the engine, each turbine segment 31 is thermally deformed so that the clearance in each circumferential end portion thereof is more reduced than in the circumferential middle portion thereof, and can be made uniform over the entire circumference thereof by properly selecting the difference in the clearance between the middle part and each end part. Thereby, the leakage of air through this clearance can be minimized without causing any undue thermal stresses.

Such an uneven distribution of the clearance between the outer circumferential surface of the axial wall and opposing surface of the turbine casing can be accomplished in a number of different ways. In the illustrated embodiment, it is accomplished simply by offsetting the curvature center of the outer circumferential surface of the axial wall with respect to the rotational center line of the engine. The distribution of the clearance can be selected in dependence on the operating temperature of the engine and thermal expansion coefficients of the shroud segments and other associated component parts. In the illustrated embodiment, the amount of this offset is optimally selected so that the air leakage may be minimized without causing any undue stresses.

Figure 5:
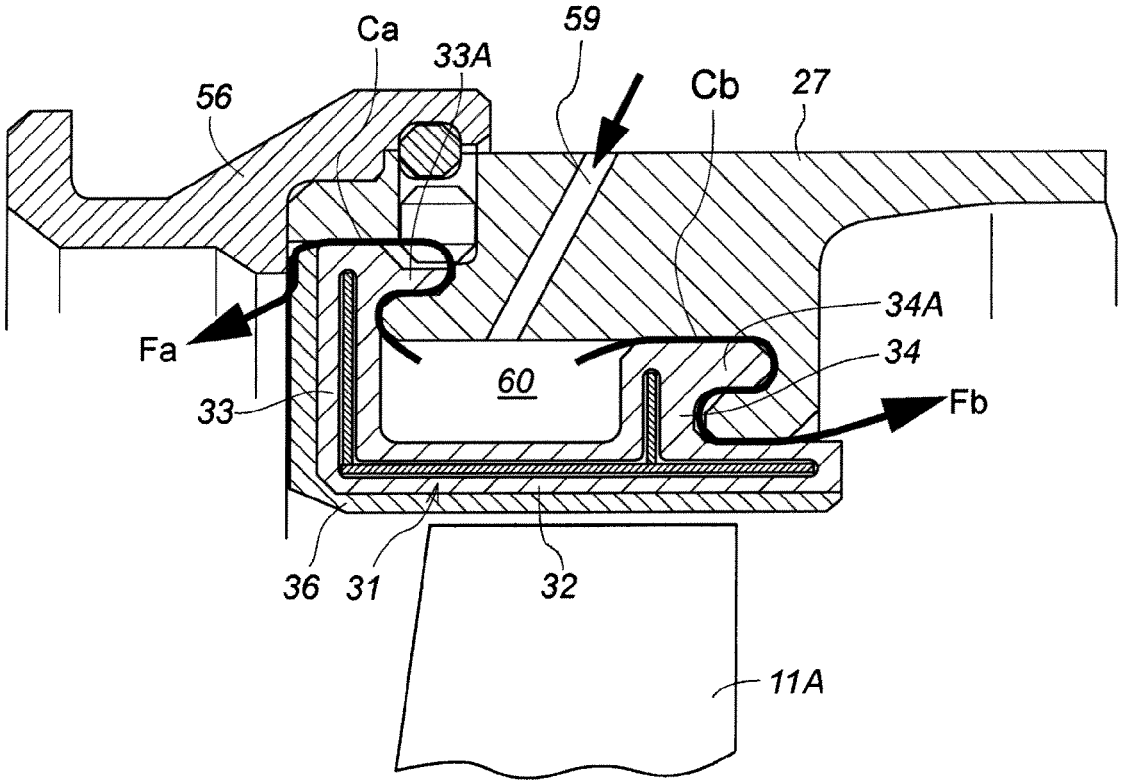
FIG. 5 is a view similar to FIG. 4 illustrating the paths of cooling air leakage.

Thus, even when a radial thermal gradient is produced, each shroud segment 31 is not subjected to any undue thermal stress, and the leaking of cooling air due to the presence of the clearances Ca and Cb as indicated by flow lines Fa and Fb in FIG. 5 can be minimized. As a result, the durability of the shroud segments is improved, and the performance of the turbine can be ensured owing to the reduction in the leakage of the cooling air. Also, the fuel economy of the jet engine 1 is improved, and the amount of air that is required to avoid the backflow of combustion gas from the turbine chamber 28 to the cooling fluid chamber 60 can be minimized.

Figure 7:
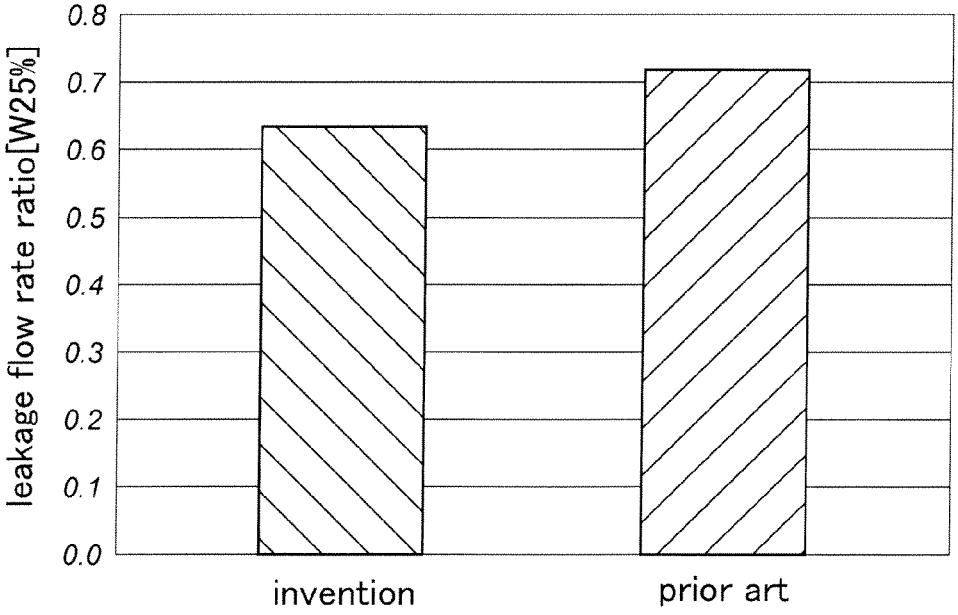
FIG. 7 is a graph comparing the air leakage of the turbine shroud of the present invention to that of the prior art.

FIG. 7 is a graph comparing the air leakage flow rate ratio of the illustrated embodiment to that of the prior art. Whereas the air leakage flow rate ratio of the prior art was 0.72%, that of the present invention was 0.63%.

Furthermore, in the illustrated embodiment, each circumferential end of the outer circumferential surface of the axial wall of each hook portion is formed as a planar sloping surface 45 so that the possibility of the circumferential edges of each shroud segment scrubbing the opposing circumferential surface of the turbine casing 27 can be eliminated. Each sloping surface 45, not only in this embodiment but also in other embodiments, may also be slightly curved without departing from the spirit of the present invention.

Also, the presence of these sloping surfaces 45 contributes to the minimization of stress concentration in these regions due to the presence of the terminal ends of the first and second slots 40 and 41. This also contributes to the improvement in the durability of the shroud segments 31.

Figure 8:
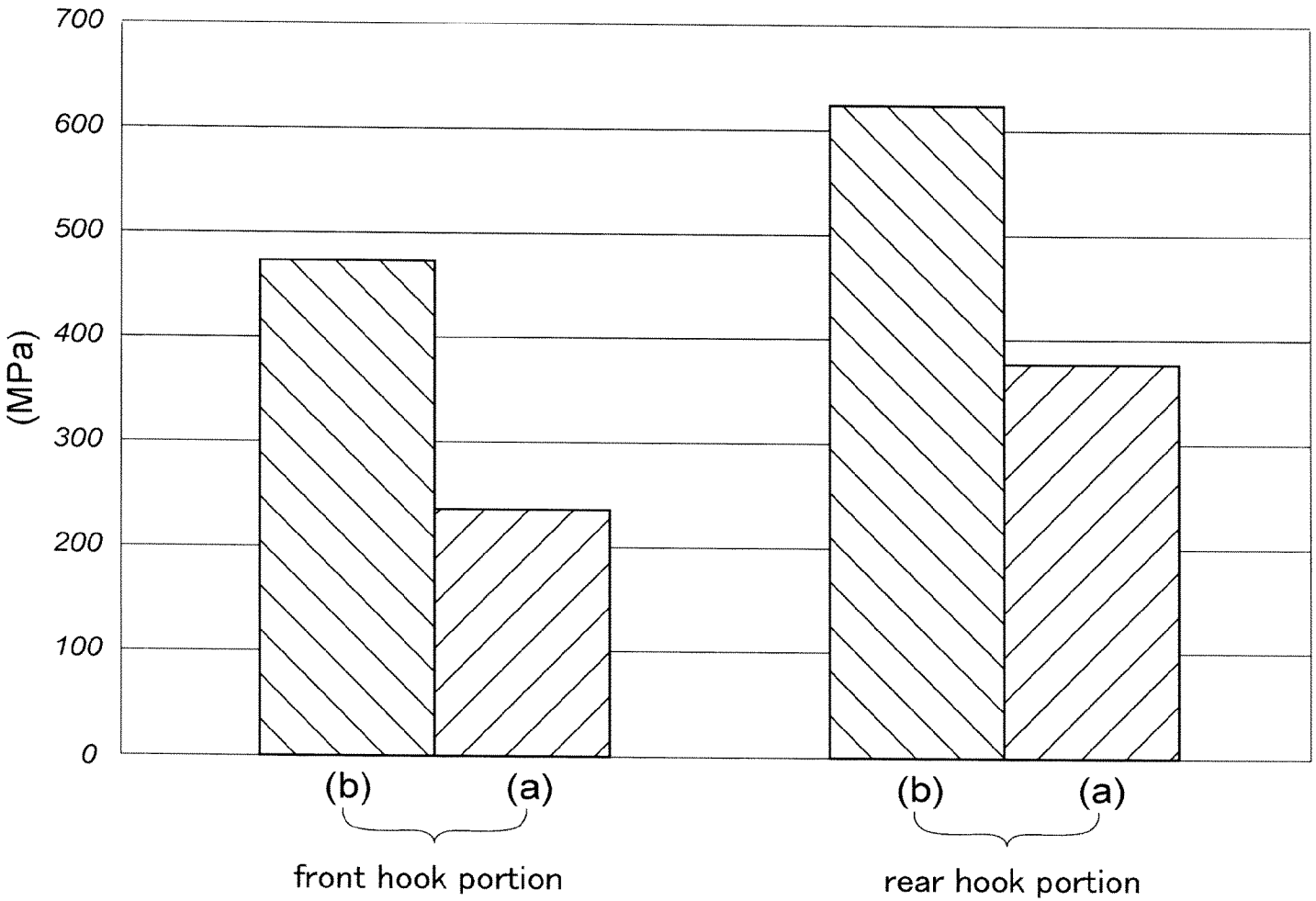
FIG. 8 is a graph comparing the stresses of the turbine shroud of the present invention to those of the prior art.

FIG. 8 compares the stresses in the axial walls 33A and 34A of the hook portions 33 and 34 with and without the sloping surfaces 45. In this graph, (a) indicates the case where the slanting surfaces 45 are provided, and (b) indicates the case where the slanting surfaces 45 are not provided. It can be seen that the presence of the sloping surfaces 45 is highly effective in reducing the stresses in the hook portions 33 and 34.

Figure 9:
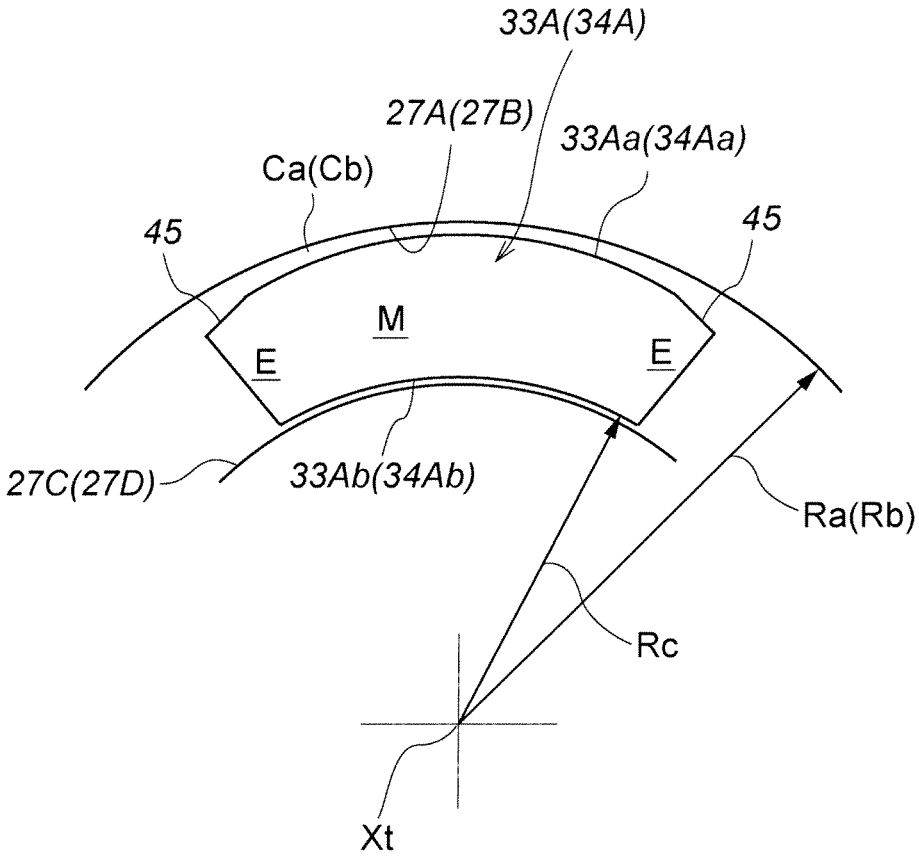
FIG. 9 is a view similar to FIG. 6 illustrating a second embodiment of the present invention.

FIG. 9 shows a second embodiment of the present invention. In this embodiment, the inner circumferential surfaces 27A and 27B of the annular axial slots 51 and 52 of the turbine casing 27 opposing the outer circumferential surfaces 33Aa and 34Aa of the front and rear axial walls 33A and 34A, respectively, are defined by cylindrical surfaces centered around the rotational center Xt of the turbine and having radii of Ra and Rb, respectively, and the outer circumferential surfaces 33Aa and 34Aa of the axial walls 33A and 34A are defined by non-cylindrical surfaces such as elliptic and parabolic surfaces that define a greater clearance in each circumferential end than in the circumferential middle part. The outer circumferential surfaces of the axial walls are each additionally formed with a planar sloping surface 45 at each circumferential end thereof.

In this case also, when the surrounding temperature is low, the clearance is greater in each circumferentially terminal end than in the circumferentially middle part. In other words, the thickness of the axial of each hook portion is greater in the circumferentially middle part than in each circumferentially terminal end.

Therefore, in this embodiment also, when the engine is warmed up, the clearance can be made even substantially over the entire circumference of each axial wall, and the advantages similar to those of the previous embodiment can be obtained.

Figure 10A:
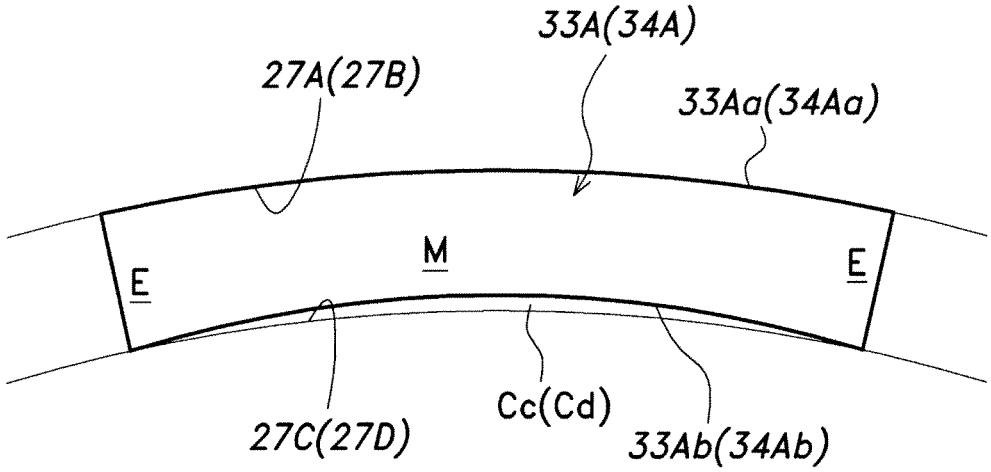
FIGS. 10A and 10B are diagrams illustrating a change in the shape of a shroud segment of a third embodiment of the present invention caused by thermal expansion.
Figure 10B:
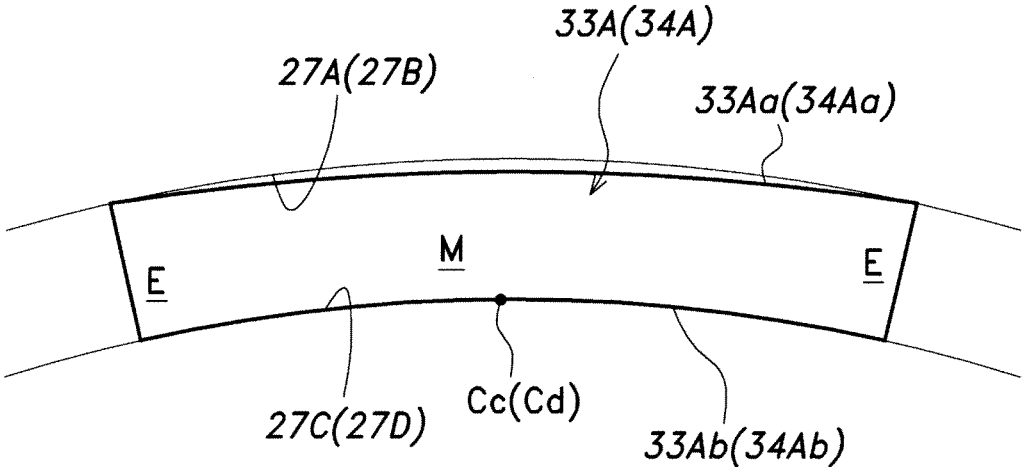

FIGS. 10A and 10B show a third embodiment of the present invention. In particular, FIG. 10A shows the state of a shroud segment 31 when the engine is cold, and FIG. 10B shows the state of the shroud segment 31 when the engine is warmed up. The shroud segment 31 is configured such that, when the engine is cold, the clearance Cc, Cd between the inner circumferential surface 33Ab, 34Ab of each axial wall 33A, 34A and opposing outer circumferential surface 27C, 27D of the annular axial slot 51, 52 is greater in a circumferential middle part M thereof than each circumferential end part thereof E.

In this case, whereas the outer circumferential surface 33Aa, 34Aa of each axial wall 33A, 34A consists of a cylindrical surface centered around the rotation center Xt of the turbines, the inner circumferential surface 33Ab, 34Ab of the axial wall 33A, 34A is centered around an axial center offset from the rotation center Xt of the turbines, and is given with a smaller curvature radius. The outer circumferential surfaces 27C, 27D of the corresponding annular axial slots 51, 52 are also defined by cylindrical surfaces centered around the rotation center Xt of the turbines. Therefore, the inner circumferential surface 33Ab, 34Ab of each axial wall 33A, 34A is not concentric to the opposing inner circumferential surface 27C, 27D of the corresponding annular axial slot 51, 52.

In this embodiment also, when the engine is warmed up, the clearance Cc, Cd on the inner circumferential surface of each axial wall can be made substantially uniform from a circumferential middle part thereof to each circumferential end part thereof. Thereby, the clearance can be minimized as a whole without causing any undue thermal stress, and this improves the sealing performance of the engagement feature of each shroud segment such as the axial walls of the illustrated embodiment.

The inner circumferential surface 33Ab, 34Ab of the axial wall 33A, 34A may also be formed by an elliptic, parabolic of other non-circular cylindrical surface.

Figure 11A:
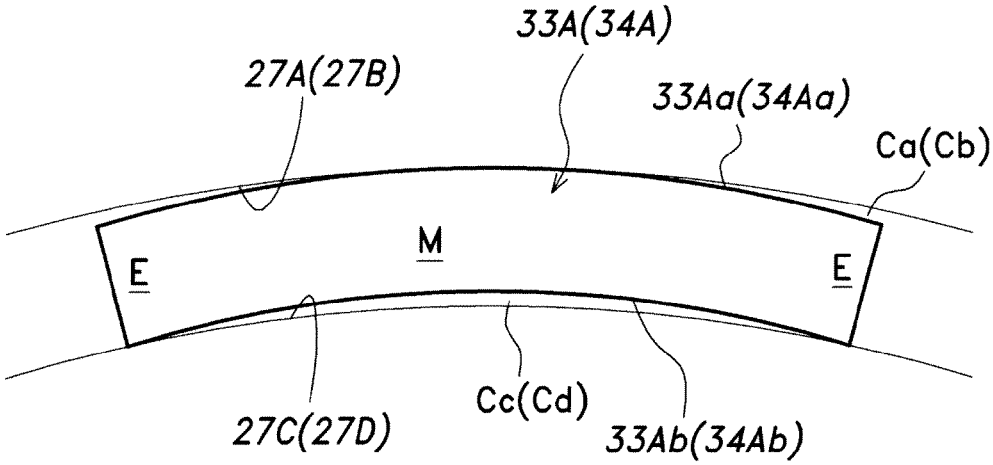
FIGS. 11A and 11B are diagrams illustrating a change in the shape of a shroud segment of a fourth embodiment of the present invention caused by thermal expansion.
Figure 11B:
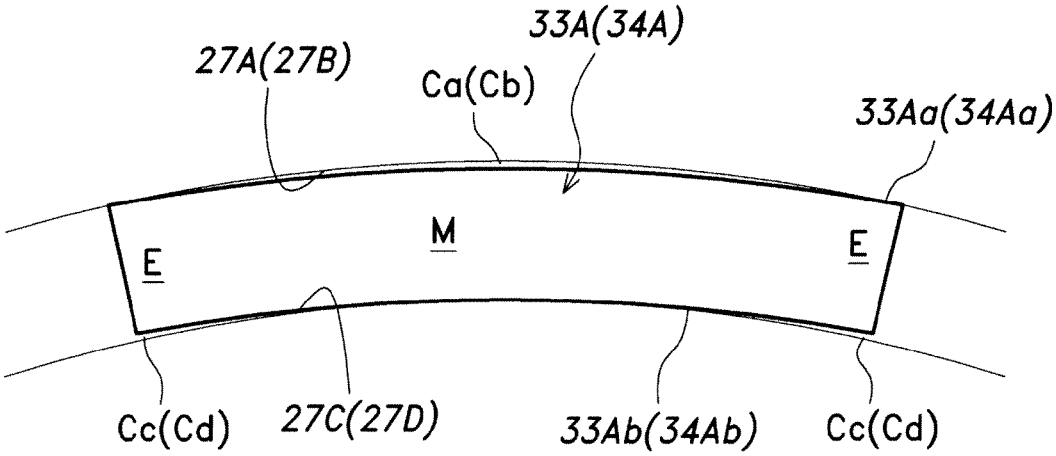

FIGS. 11A and 11B show a fourth embodiment of the present invention. In particular, FIG. 11A shows the state of a shroud segment 31 when the engine is cold, and FIG. 11B shows the state of the shroud segment 31 when the engine is warmed up. The shroud segment 31 is configured such that, when the engine is cold, the clearance Cc, Cd between the inner circumferential surface 33Ab, 34Ab of each axial wall 33A, 34A and opposing outer circumferential surface 27C, 27D of the annular axial slot 51, 52 is greater in a circumferential middle part M thereof than in each circumferential end part thereof E, and, additionally, the clearance Ca, Cb between the outer circumferential surface 33Aa, 34Aa of each axial wall 33A, 34A and opposing inner circumferential surface 27A, 27B of the annular axial slot 51, 52 is greater in each circumferential end part thereof E than in a circumferential middle part M thereof.

In this case also, when the engine is warmed up, the thermal deformation of the shroud segment 31 causes the gaps of both the inner and outer circumferences of the axial wall of each hook portion to be made substantially even over the entire circumference thereof.

Figure 12A:
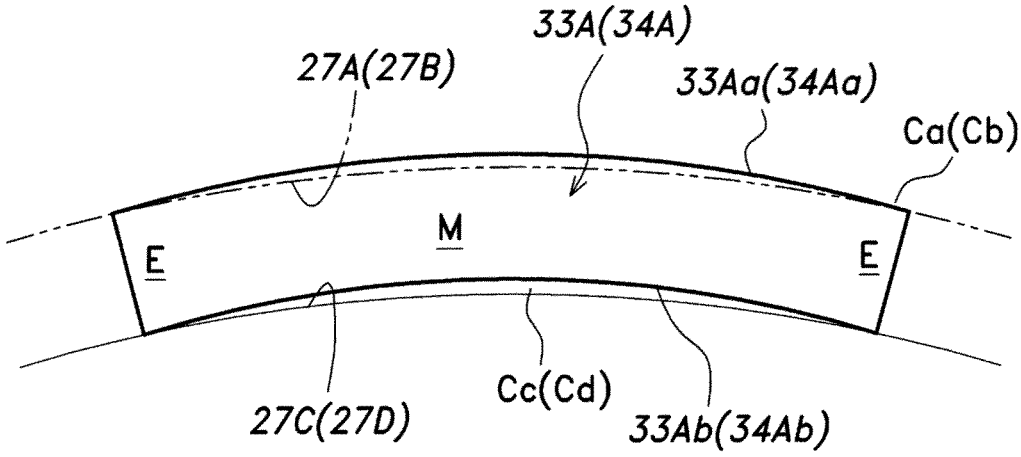
FIGS. 12A and 12B are diagrams illustrating a change in the shape of a shroud segment of a fifth embodiment of the present invention before and after a press fit.
Figure 12B:
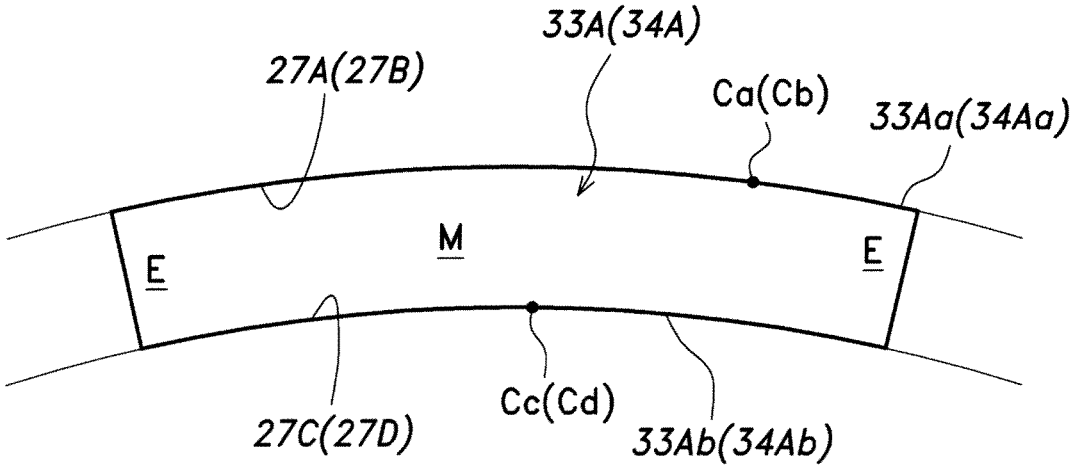

FIGS. 12A and 12B show a fifth embodiment of the present invention. In particular, FIG. 12A shows the state of a shroud segment 31 when the engine is cold, and FIG. 12B shows the state of the shroud segment 31 when the engine is warmed up. In this embodiment, each shroud segment 31 is press fitted into the corresponding annular axial slot 51, 52 of the turbine casing 27. The shroud segment 31, when cold, is given with a smaller curvature radius than the corresponding annular axial slot, and is brought into a pre-stressed state when press fitted into the annular axial slot. However, as the engine is warmed up, the curvature of the shroud segment 31 is increased owing to the radial temperature gradient thereof so that the shroud segment 31 becomes conformal to the annular axial slot. As a result, the pre-tress of the shroud segment 31 is removed, and the thermal stress in the shroud segment 31 when the engine is in operation can be minimized.

In any of the preceding embodiments, the desired distribution of the clearance in each shroud segment can be provided only in one of the front and rear hook portions depending on the particular need of the engine design.

Although the present invention has been described in terms of preferred embodiments thereof, it is obvious to a person skilled in the art that various alterations and modifications are possible without departing from the scope of the present invention which is set forth in the appended claims.

The contents of the original Japanese patent application on which the Paris Convention priority claim is made for the present application are incorporated in this application by reference.

The invention claimed is:

1. A turbine shroud attached to an inner circumferential surface of a turbine casing and surrounding tips of turbine rotor blades in a gas turbine engine coaxially with respect to a center line of the engine, the turbine shroud comprising a plurality of arcuate shroud segments combined into an annular configuration, each shroud segment including a main body defining an inner circumferential surface opposing the tips of the turbine rotor blades at a small clearance and an engagement feature including an axial wall having a prescribed circumferential length and a prescribed axial length, the turbine casing including an axial slot extending coaxially around the center line of the engine and configured to receive the axial wall of each shroud segment, wherein a clearance defined between each circumferential end part of an inner circumferential surface of the axial wall and an opposing outer circumferential surface of the turbine casing is smaller than that defined between a circumferentially middle part of the inner circumferential surface of the axial wall and an opposing outer circumferential surface of the turbine casing, under a cool condition of the engine.

2. The turbine shroud according to claim 1, wherein the engagement feature comprises at least one hook portion including a radial wall extending radially outward from the main body of each shroud segment in addition to the axial wall, and the shroud segments are arranged substantially continually over an entire circumference of the turbine shroud.

3. The turbine shroud according to claim 2, wherein each turbine segment comprises a front hook portion and a rear hook portion, and, with respect to at least one of the hook portions, a clearance defined between each circumferential end part of an outer circumferential surface of the axial wall and an opposing inner circumferential surface of the turbine casing is greater than that defined between the circumferentially middle part of the outer circumferential surface of the axial wall and an opposing inner circumferential surface of the turbine casing under the cool condition of the engine.

4. The turbine shroud according to claim 2, wherein each turbine segment comprises a front hook portion and a rear hook portion, and, with respect to at least one of the hook portions, a clearance defined between each circumferential end part of the axial wall and the opposing outer circumferential surface of the turbine casing is smaller than that defined between the circumferentially middle part of the axial wall and the opposing outer circumferential surface of the turbine casing under the cool condition of the engine.

5. The turbine shroud according to claim 1, wherein a clearance defined between each circumferential end part of an outer circumferential surface of the axial wall and an opposing inner circumferential surface of the turbine casing is greater than that defined between a circumferentially middle part of the outer circumferential surface of the axial wall and an opposing inner circumferential surface of the turbine casing under the cool condition of the engine, and wherein each circumferential end part of the axial wall has a smaller thickness than the circumferentially middle part of the axial wall under the cool condition of the engine.

6. The turbine shroud according to claim 5, wherein each circumferential end part of the outer circumferential surface of the axial wall is formed as a slanting surface defining a progressively thinner wall thickness toward a corresponding circumferential edge of the circumferential end part.

7. The turbine shroud according to claim 5, wherein at least one of the outer circumferential surface and inner circumferential surface of the axial wall is defined by a non-cylindrical curved surface.

8. A turbine shroud attached to an inner circumferential surface of a turbine casing and surrounding tips of turbine rotor blades in a gas turbine engine coaxially with respect to a center line of the engine, the turbine shroud comprising a plurality of arcuate shroud segments combined into an annular configuration, each shroud segment including a main body defining an inner circumferential surface opposing the tips of the turbine rotor blades at a small clearance and an engagement feature including an axial wall having a prescribed circumferential length and a prescribed axial length, the turbine casing including an axial slot extending coaxially around the center line of the engine and configured to receive the axial wall of each shroud segment, wherein: a clearance defined between each circumferential end part of an outer circumferential surface of the axial wall and an opposing inner circumferential surface of the turbine casing is greater than that defined between a circumferentially middle part of the outer circumferential surface of the axial wall and an opposing inner circumferential surface of the turbine casing and/or a clearance defined between each circumferential end part of an inner circumferential surface of the axial wall and an opposing outer circumferential surface of the turbine casing is smaller than that defined between a circumferentially middle part of the inner circumferential surface of the axial wall and an opposing outer circumferential surface of the turbine casing, under a cool condition of the engine, and wherein the inner circumferential surface of the axial wall is defined by a first cylindrical surface, and the outer circumferential surface of the axial wall is defined by a second cylindrical surface, an axial center line of the first cylindrical surface being offset relative to an axial center line of the second cylindrical surface.

* * * * *